US005915623A

United States Patent [19]

Knight et al.

[11] Patent Number: 5,915,623

[45] Date of Patent: Jun. 29, 1999

[54] INJECTOR ARRANGEMENT

[75] Inventors: Andrew Roger Knight, Four Ashes; Andrew Male, London, both of United Kingdom

[73] Assignees: Lucas Industries, Solihull, United Kingdom; Caterpillar, Inc., Peoria, Ill.

[21] Appl. No.: 08/955,676

[22] Filed: Oct. 22, 1997

[30] Foreign Application Priority Data

Oct. 26, 1996 [GB] United Kingdom ..... 9622335

[51] Int. Cl.[6] ..... F02M 47/02

[52] U.S. Cl. ..... 239/88; 239/127; 239/533.8

[58] Field of Search ..... 239/129, 127, 239/533.8, 88

[56] References Cited

U.S. PATENT DOCUMENTS

| | | | |
|---|---|---|---|
| 4,758,169 | 7/1988 | Steiger | 239/533.8 X |
| 4,852,808 | 8/1989 | Yamamoto | 239/533.8 X |
| 4,934,599 | 6/1990 | Hasagawa | 239/533.8 X |
| 5,072,882 | 12/1991 | Taue et al. | 239/124 X |
| 5,167,370 | 12/1992 | Henkel | 239/533.8 |
| 5,542,610 | 8/1996 | Augustin | 239/533.8 |

FOREIGN PATENT DOCUMENTS

| | | | |
|---|---|---|---|
| 4115477 | 11/1991 | Germany | 239/533.8 |

*Primary Examiner*—Kevin Weldon

*Attorney, Agent, or Firm*—Wells, St. John, Roberts, Gregory & Matkin, P.S.

[57] ABSTRACT

An injector arrangement is disclosed which comprises a valve needle urged into engagement with a seating under the action of the pressure of fuel within a control chamber. A needle control valve controls communication between a source of fuel at high pressure and the control chamber, and also between the control chamber and a low pressure drain. The needle control valve includes a valve member including an end which is engageable with a surface extending in a plane normal to the axis of the valve member to close a port communicating with the low pressure drain.

8 Claims, 4 Drawing Sheets

INJECTOR ARRANGEMENT

This invention relates to an injector arrangement for use in supplying fuel, under pressure, to the cylinders of an internal combustion engine. In particular, this invention relates to an injector arrangement in which the injector has a respective pump associated therewith, for example a pump/injector or a long pipe arrangement in which the injector is connected to its pump by a pipe.

A known pump/injector arrangement comprises a plunger reciprocable within a bore provided in a housing to pressurize fuel located within the bore. The bore communicates with a fuel pressure actuated injector such that once the fuel pressure within the bore exceeds a predetermined level, the injector opens thus fuel injection commences.

In order to permit independent control of the injection pressure and the timing of injection, it is known to provide a pressure control valve which communicates with the bore, and an injection control valve which controls the pressure applied to a control chamber defined, in part, by a surface of a needle of the injector to control movement of the needle. In use, the pressure control valve remains open during initial inward movement of the plunger. Subsequently, the pressure control valve is closed, further inward movement of the plunger pressurizing the fuel within the bore. When injection is to commence, the injection control valve is actuated to connect the control chamber to a low pressure drain thus permitting movement of the needle away from its seating to commence injection.

In some known arrangements, the pressure control valve and injection control valve are actuated by a single electromagnetic actuator. Such arrangements are advantageous in that fewer electrical connections to the injector are required than where the valves are controlled by independent actuators.

One arrangement including a single actuator includes an injection control valve in which the valve member includes an axially extending passage forming part of the delivery line through which fuel is supplied towards the injector seating. Clearly, in such an arrangement, the valve member needs to be relatively large in order to provide a sufficient wall thickness to withstand the fuel pressure therein.

It is an object of the invention to provide an injector including an injection control valve of relatively simple form.

According to the present invention there is provided an injector arrangement comprising a pump including a bore within which a pumping plunger is reciprocable, and an injector including pressure control valve arranged to control communication between the bore and a low pressure reservoir, an injector needle engageable with a seating, the needle being resiliently biased into engagement with the seating, a control chamber arranged such that the fuel pressure therein urges the needle towards its seating, a needle control valve arranged to control communication between the bore and the control chamber and between the control chamber and a low pressure drain, and individual actuator arrangements for actuating the pressure control valve and needle control valve independently of one another, wherein the needle control valve comprises a valve member slidable within a bore, an end of the valve member being sealingly engageable with a surface extending in a plane normal to the axis of the valve member to close a port communicating with the low pressure drain.

Such an arrangement is advantageous in that reliable control of the valves may be achieved relatively easily. Further, by providing the drain port substantially coaxially with the control valve member, the provision of a delivery line extending along the axis of the control valve member, as in a known arrangement, can be avoided.

In addition, the use of an arrangement in which the control valve member is engageable with a surface extending in a plane normal to the axis of the valve member rather than with a seating coaxial therewith increases the tolerance to manufacturing inaccuracies.

The pump and injector may be combined to form a pump/injector, or may be spaced apart from one another, a pipe being arranged to transfer fuel from the pump to the injector.

The invention will further be described, by way of example, with reference to the accompanying drawings, in which.

Figure 1:
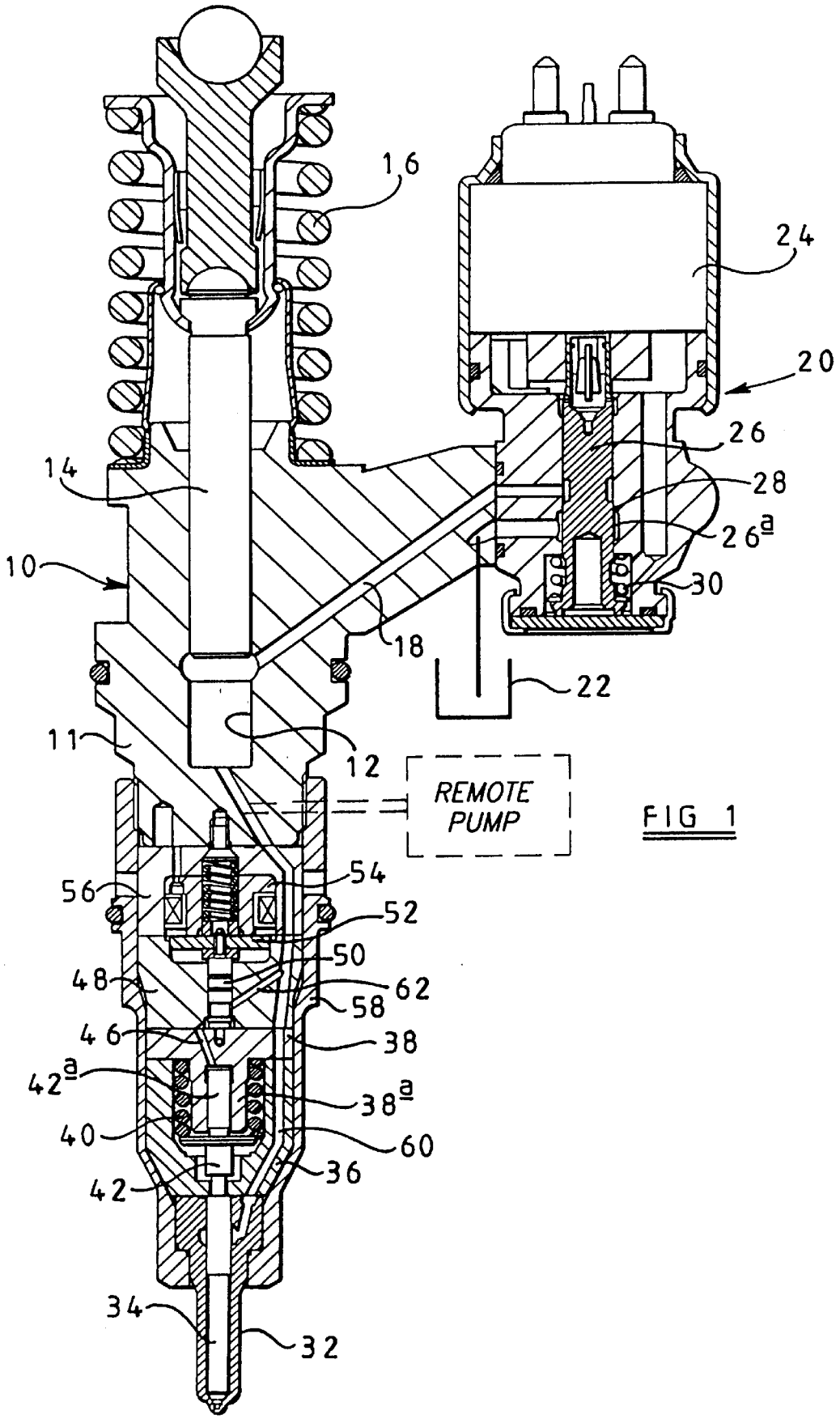
FIG. 1 is a sectional view of an injector in accordance with an embodiment of the invention.
Figure 2:
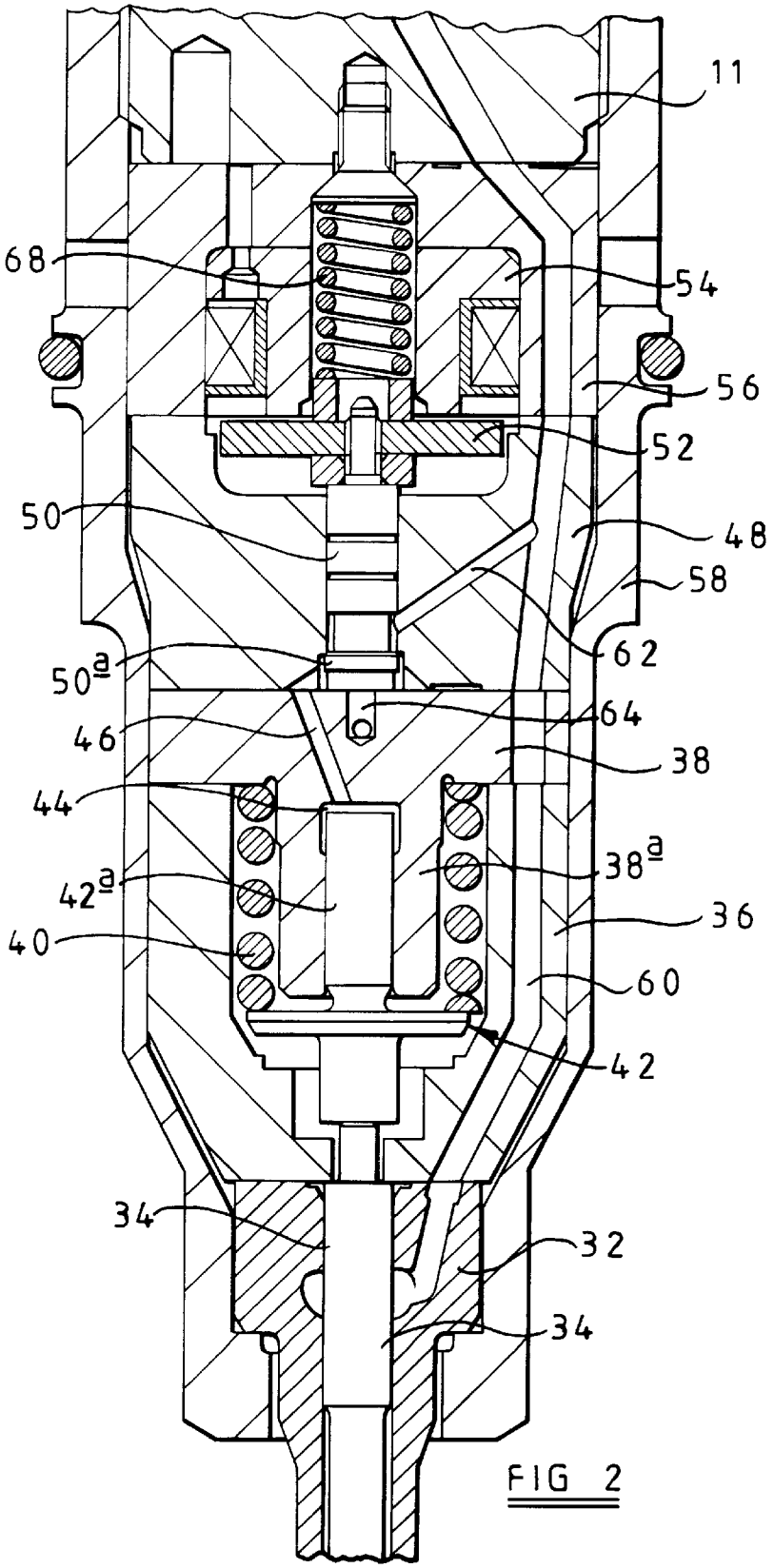
FIG. 2 is an enlarged view of part of FIG. 1.

The fuel injector illustrated in FIGS. 1 and 2 comprises a multi-part housing 10 including a housing part 11 having a bore 12 formed therein. A plunger 14 is reciprocable within the bore under the action of a cam arrangement, a return spring 16 being provided in order to withdraw the plunger 14 from the bore 12. The bore 12 communicates through a passage 18 with a pressure control spill valve 20 which controls communication between the passage 18 and a low pressure drain 22.

As illustrated, the spill valve 20 comprises an electromagnetically operated valve including an actuator 24 the armature of which is connected to a valve member 26 which includes a region 26*a* of enlarged diameter which is engageable with a seating 28 located so that when the enlarged region 26*a* engages the seating 28 communication between the passage 18 and the low pressure drain 22 is not permitted, movement of the enlarged region 26*a* away from its seating permitting such communication. A spring 30 is located so as to bias the valve member 26 towards a position in which the enlarged region 26*a* thereof is spaced from its seating 28, energization of the actuator 24 moving the valve member 26 against the action of the spring 30 to break communication between the passage 18 and low pressure drain 22.

The multi-part housing 10 further comprises a nozzle body 32 defining a bore within which a valve needle 34 is slidable, the valve needle 34 being engageable with a seating in order to control flow of fuel towards one or more outlet apertures (not shown) provided in an end of the nozzle body 32. The nozzle body 32 abuts a distance piece 36 which includes a through bore coaxial with the bore provided in the nozzle body 32, the through bore of the distance piece 36 including a region of enlarged diameter.

A first valve housing 38 abuts the end of the distance piece 36 remote from the nozzle body 32, the first valve housing 38 including a projection 38*a* which extends within the enlarged diameter region of the through bore of the distance piece 36, the first valve housing 38 and distance piece 36 together defining a spring chamber within which a spring 40 is located. The spring 40 is engaged between the first valve housing 38 and a spring abutment member 42 which abuts an end of the valve needle 34.

The projection 38*a* includes a blind bore within which a projection 42*a* forming part of the abutment member 42 is slidable, the bore and projection 42*a* together defining a control chamber 44 which communicates through a passage 46 with an end face of the first valve housing 38 facing away from the distance piece 36.

The face of the first valve housing 38 facing away from the distance piece 36 abuts a second valve housing 48 which is provided with a through bore within which a valve member 50 is slidable. The valve member 50 is secured to an armature 52 which is moveable under the influence of a stator 54 located within a stator housing 56, the stator housing 56 being located between the second valve housing 48 and the housing part 11. A cap nut 58 is in screw-threaded engagement with the housing part 11, the cap nut 58 securing the nozzle body 32, distance piece 36, first and second valve housings 38, 48 and stator housing 56 to the housing part 11. The housing part 11, stator housing 56, first and second valve housings 38, 48 distance piece 36 and nozzle body 32 are each provided with drillings which together form a delivery line 60 permitting fuel to flow from the bore 12 to the bore provided in the nozzle body 32 to act against appropriately orientated thrust surfaces of the needle 34 to urge the needle 34 away from its seating.

A drilling 62 is provided in the second valve housing 48, the drilling 62 providing a communication path between the passage 46 and the supply line 60. As shown most clearly in FIG. 2, the drilling 62 communicates with the through bore of the second valve housing 48, the drilling 62 being located such that the part of the through bore at the end face of the second valve housing 48 is of non-circular shape, the drilling 62 breaking into the through bore at the end face of the second valve housing. The through bore is shaped so as to define a seating located such that when an enlarged diameter region 50*a* of the valve member 50 engages the seating, communication between the passage 46 and delivery line 60 is broken, movement of the enlarged region 50*a* away from its seating permitting such communication thus resulting in the fuel pressure within the control chamber 44 being substantially equal to that within the delivery line 60. It will be appreciated that in such circumstances, the force acting on the valve needle 34 urging the valve needle 34 into engagement with its seating due to the pressure within the control chamber 44 and due to the action of the spring 40 is greater than the forces urging the valve needle 34 away from its seating due to the action of fuel against the thrust surfaces of the valve needle 34. The valve needle 34 therefore occupies a position in which it engages its seating in such circumstances.

An end of the valve member 50 is sealingly engageable with a surface of the first valve housing 38 facing the second valve housing 48, such sealing engagement breaking communication between the through bore of the second valve housing 48 and a drilling 64 provided in the first valve housing 38 substantially coaxially with the through bore of the second valve housing 48, the drilling 64 being arranged to communicate with a suitable low pressure drain through a suitable drain passage. The drain passage further communicates with the spring chamber thus movement of the spring abutment member 42, in use, does not result in significant pressurization of fuel within the spring chamber. A recess is conveniently provided in the end face of the valve member 50 facing the first valve housing 38, the recess being aligned with the drilling 64.

In use, starting from the position illustrated in FIG. 1, the valve member 50 is in engagement with the first valve housing 38 thus the fuel pressure within the control chamber 44 is substantially equal to that within the delivery line 60. As indicated hereinbefore, in such circumstances the valve needle 34 engages its seating thus injection does not take place. The plunger 14 is in its outermost position, the bore 12 being charged with fuel, and the valve 20 occupies a position in which communication between the passage 18 and low pressure drain 22 is permitted. From this position, the plunger 14 commences inward movement into the bore 12. Such movement results in fuel being displaced through the valve 20 to the low pressure drain 22.

When it is determined that pressurization of the fuel within the bore 12 should commence, the actuator 24 of the valve 20 is energized resulting in movement of the valve member 26 thereof to bring the enlarged region 26*a* into engagement with its seating thus terminating the flow of fuel from the bore 12 to the low pressure drain 22. It will be appreciated that continued inward movement of the plunger 14 therefore results in the pressure of fuel within the bore 12 increasing. The pressure of fuel applied to the thrust surfaces of the valve needle 34 and also the pressure of fuel applied to the control chamber 44 thus also increase. The communication between the control chamber 44 and the delivery line 60 ensures that a sufficiently high force is applied to the valve needle 34 during such pressurization to maintain the engagement between the valve needle 34 and seating thus injection does not commence.

When injection is to be commenced, the stator 54 is energized to attract the armature 52 towards the stator against the action of a spring 68, the movement of the armature 52 resulting in movement of the valve member 50 to lift the end thereof away from the end face of the first valve housing 38 and to bring the enlarged region 50*a* of the valve member 50 into engagement with its seating. Such movement of the valve member 50 breaks communication between the control chamber 44 and the delivery line 60 and instead permits communication between the control chamber 44 and the low pressure drain. The pressure within the control chamber 44 therefore falls. The reduced pressure within the control chamber 44 results in reduction in the force urging the valve needle 34 into engagement with its seating, and a point will be reached at which the pressure acting against the thrust surfaces of the valve needle 34 is sufficient to overcome the action of the spring 40 and fuel pressure within the control chamber 44 to lift the valve needle 34 away from its seating and hence permit fuel to flow past the seating of the nozzle body 32 to the outlet apertures and hence commence injection.

In order to terminate injection, the stator 54 is de-energized thus the armature 52 and valve member 50 return under the action of the spring 68 to the position shown in FIGS. 1 and 2. In this position, the control chamber 44 no longer communicates with the low pressure drain and instead communicates with the supply passage 60. The fuel pressure within the control chamber 44 therefore increases, and a point will be reached at which the fuel pressure within the control chamber 44 is sufficient to return the valve needle 34 towards its seating thus terminating injection. At or after termination of injection, the valve 20 is de-energized thus the valve member 26 thereof moves under the action of the spring 30 to a position in which fuel from the bore 12 is able to flow through the valve 20 to the low pressure drain 22. The fuel pressure within the bore 12 therefore falls. Continued inward movement of the plunger 14 results in further fuel being displaced through the valve 20 to the low pressure drain 22. Subsequently, the plunger 14 is withdrawn from the bore 12 under the action of the spring 16 thus fuel is drawn into the bore 12 from the low pressure drain 22 through the valve 20. Fuel continues to flow to the bore 12 until the plunger 14 occupies its outermost position, the valve 20 remaining in its de-energized state throughout the outward movement of the plunger 14. Continued outward movement of the plunger 14 results in the injector returning to the position illustrated in FIGS. 1 and 2 ready for the commencement of the next pumping and injection cycle.

Figure 3:
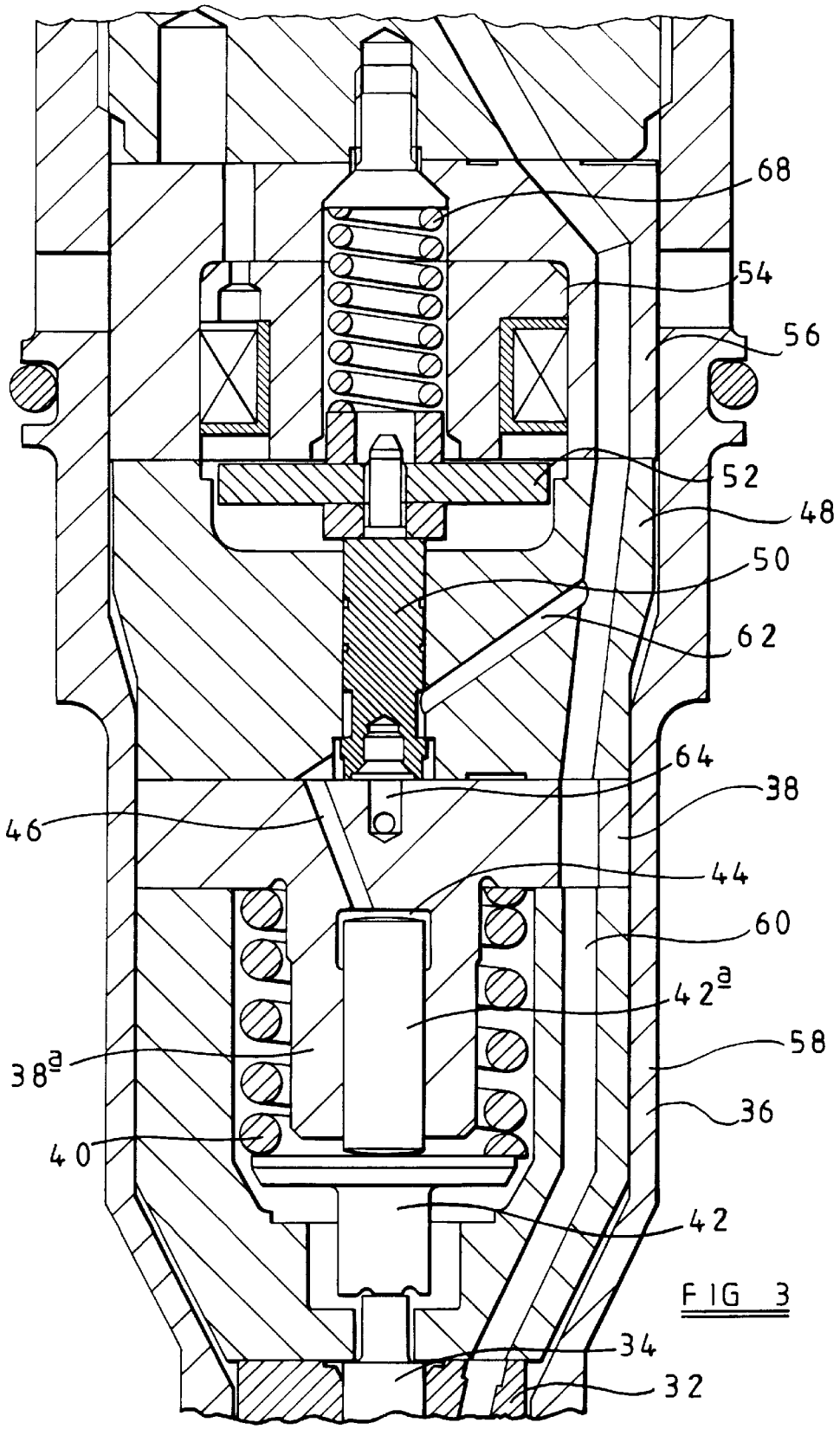
FIG. 3 is a view similar to FIG. 2 of an alternative injector.

FIG. 3 illustrates an arrangement which is similar to that of FIGS. 1 and 2, but in which the spring abutment member 42 includes a separate rather than integral projection 42*a*. The provision of an integral projection 42*a* has the advantage that the spring abutment member 42 is guided, but the disadvantage that the spring abutment member 42 is of relatively complex shape. There may, therefore, be circumstances in which it is preferred to use the arrangement of FIG. 3 in which the projection is not integral with the spring abutment member 42.

Figure 4:
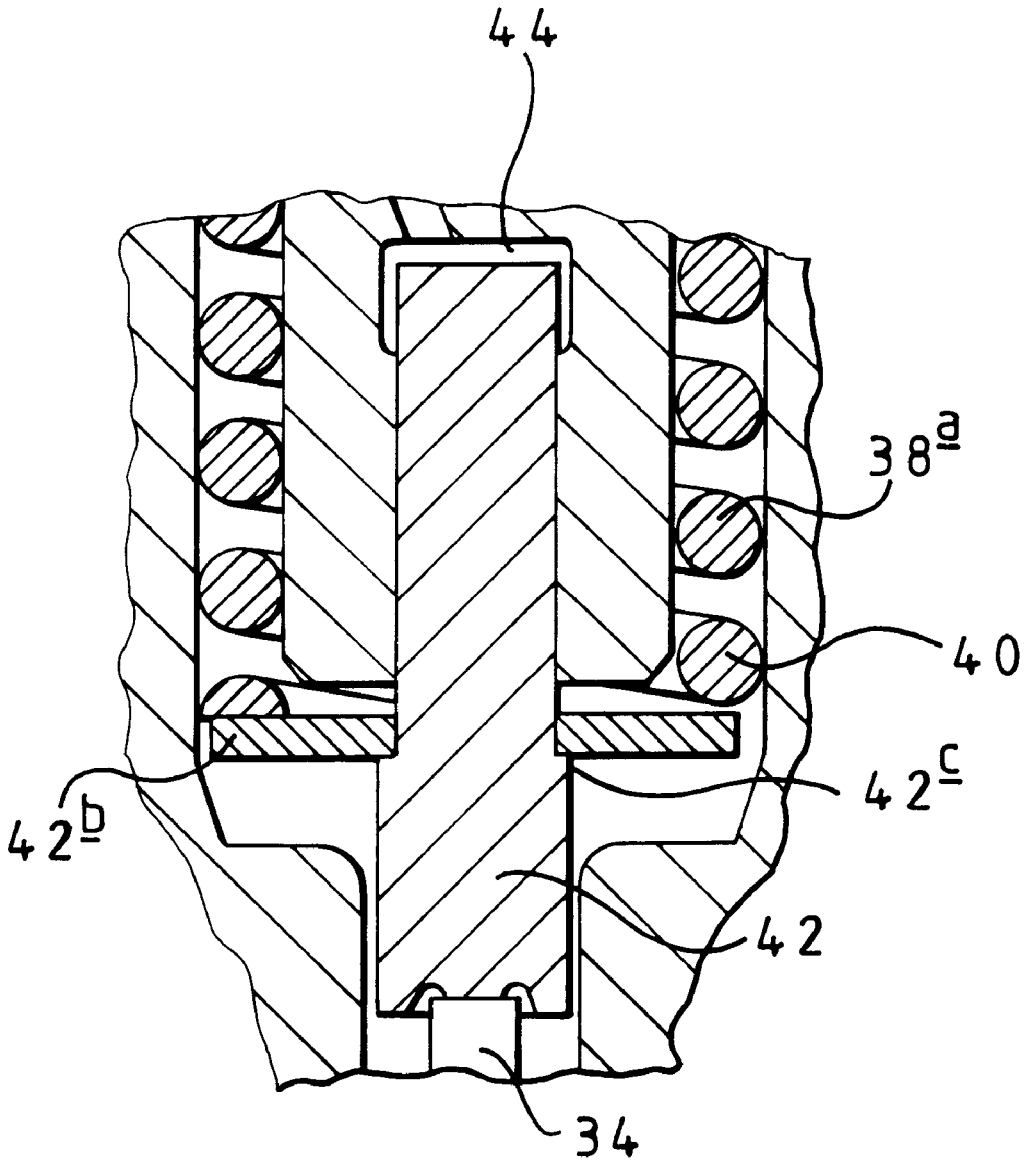
FIG. 4 is a diagrammatic cross sectional view of part of a further alternative injector.

FIG. 4 illustrates a further alternative in which the projection 42*a* is integral with a part of the spring abutment member 42 which engages the valve needle, the spring abutment member 42 including a separate annular abutment member 42*b* which is engageable with a shoulder 42*c* provided on the spring abutment member 42, the annular abutment member 42*b* being arranged to engage the spring 40, in use.

It will be appreciated that the injection control valve is of a relatively simple form, and as the supply of fuel to the injector does not pass through the injection control valve, the injection control valve merely being used to control the pressure within the control chamber 44, the valve member 50 of the pressure control valve may be of relatively small diameter. Further, as the pressure control valve and injection control valve are controlled using separate actuators, reliable control of the valves may be achieved relatively easily.

Although the description hereinbefore is of a pump/injector, it will be appreciated that the invention is also applicable to an injector arrangement in which the pump is spaced apart from the injector, a suitable pipe being used to interconnect the pump and injector to permit fuel to be delivered by the pump to the injector.

We claim:

1. An injector arrangement comprising a pump including a bore within which a pumping plunger is reciprocable, and an injector including a pressure control valve arranged to control communication between the bore and a low pressure reservoir, an injector needle engageable with a seating, the needle being resiliently biased into engagement with the seating, a control chamber arranged such that the application of high pressure fuel thereto urges the needle towards its seating, a needle control valve arranged to control communication between the bore and the control chamber and between the control chamber and a low pressure drain, and individual actuators for actuating the pressure control valve and needle control valve independently of one another, wherein the needle control valve comprises a valve member slidable within a bore, an end of the valve member being sealingly engageable with a surface extending in a plane normal to the axis of the valve member to close a port communicating with the low pressure drain, and wherein a part of the valve member spaced from the end thereof is engageable with a seating to control communication between the bore and the control chamber.

2. An injector arrangement as claimed in claim 1 further comprising an abutment member having a surface exposed to the fuel pressure within the control chamber, the abutment member transmitting the force due to the action of the fuel pressure within the control chamber to the valve needle.

3. An injector arrangement as claimed in claim 2, further comprising a spring resiliently biassing the needle towards its seating, the spring engaging a spring abutment moveable with the abutment member.

4. An injector arrangement as claimed in claim 3, wherein the spring abutment is integral with the abutment member.

5. An injector as claimed in claim 3, wherein the abutment member engages the spring abutment, the force due to the fuel pressure within the control chamber being transmitted to the valve needle through the spring abutment.

6. An injector arrangement as claimed in claim 3, wherein the spring abutment is carried by the abutment member.

7. An injector arrangement as claimed in claim 1, wherein the injector is mounted upon the pump, and wherein the port which communicates with the low pressure drain is located generally coaxially with the valve member.

8. An injector arrangement as claimed in claim 1, wherein the pump and the injector are spaced apart from one another, pipe means being provided to couple, in fluid flowing communication, the bore of the pump and the injector.

* * * * *